US011634802B2

(12) United States Patent
Kaido et al.

(10) Patent No.: US 11,634,802 B2
(45) Date of Patent: Apr. 25, 2023

(54) COLD-ROLLED STEEL SHEET

(71) Applicant: NIPPON STEEL CORPORATION, Tokyo (JP)

(72) Inventors: Hiroshi Kaido, Tokyo (JP); Mai Nagano, Tokyo (JP); Koutarou Hayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 140 days.

(21) Appl. No.: 17/275,611

(22) PCT Filed: Oct. 4, 2019

(86) PCT No.: PCT/JP2019/039241
§ 371 (c)(1),
(2) Date: Mar. 11, 2021

(87) PCT Pub. No.: WO2020/071522
PCT Pub. Date: Apr. 9, 2020

(65) Prior Publication Data

US 2022/0042149 A1 Feb. 10, 2022

(30) Foreign Application Priority Data

Oct. 4, 2018 (JP) ..... JP2018-189164

(51) Int. Cl.
*C22C 38/38* (2006.01)
*C21D 6/00* (2006.01)
(Continued)

(52) U.S. Cl.
CPC ..... *C22C 38/38* (2013.01); *C21D 6/001* (2013.01); *C21D 6/002* (2013.01); *C21D 6/005* (2013.01);
(Continued)

(58) Field of Classification Search
None
See application file for complete search history.

(56) References Cited

U.S. PATENT DOCUMENTS

| | | | | |
|---|---|---|---|---|
| 2013/0160889 | A1 | 6/2013 | Aratani et al. | |
| 2016/0177414 | A1* | 6/2016 | Takashima | C21D 6/004 148/330 |
| 2022/0042149 | A1* | 2/2022 | Kaido | C22C 38/04 |

FOREIGN PATENT DOCUMENTS

| | | | |
|---|---|---|---|
| CN | 102822374 | A | 12/2012 |
| JP | 2003-277884 | A | 10/2003 |
| JP | 2008-144233 | A | 6/2008 |

OTHER PUBLICATIONS

"Metallic materials—Bend test", JIS Z 2248, 2006, pp. 732-749, total of 9 pages.

(Continued)

*Primary Examiner* — Scott R Kastler
(74) *Attorney, Agent, or Firm* — Birch, Stewart, Kolasch & Birch, LLP

(57) ABSTRACT

The cold-rolled steel sheet having a high bake hardening amount and excellent bendability after bake hardening according to the present invention has a predetermined composition, and contains 20% or more and 70% or less of ferrite and 30% or more of tempered martensite in terms of area ratio, in which a sum of ferrite and tempered martensite is 90% or more, and in a case where a microstructure image of 30 μm×30 μm obtained by photographing a structure at a magnification of 2,000-fold is disposed in an xy coordinate system having a sheet thickness direction as an x-axis and a rolling direction as a y-axis, the microstructure image is divided into 1024 pieces in an x-axis direction and 1024 pieces in a y-axis direction to form 1024×1024 divided regions, and a two-dimensional image is created by performing double gradation by assuming a value of "1" in each
(Continued)

of the divided regions in one case where the structure is ferrite and assuming a value of "0" in the other cases, a heterogeneity α when two-dimensional discrete Fourier transform is performed on the two-dimensional image is 1.20 or less.

2 Claims, 4 Drawing Sheets

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.
CPC ..... *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 2211/005* (2013.01); *C21D 2211/008* (2013.01)

(56) References Cited

OTHER PUBLICATIONS

"Metallic materials—Tensile testing-Method of test at room temperature", JIS Z 2241, 2011, pp. 477-549, total of 37 pages.

* cited by examiner

COLD-ROLLED STEEL SHEET

TECHNICAL FIELD OF THE INVENTION

The present invention relates to a cold-rolled steel sheet, and particularly to a cold-rolled steel sheet that is suitable for a structural member of a vehicle and the like, which is mainly press-formed to be used, and is excellent in bake hardening performance for coating and impact resistance. Priority is claimed on Japanese Patent Application No. 2018-189164, filed Oct. 4, 2018, the content of which is incorporated herein by reference.

RELATED ART

In recent years, from the viewpoint of a weight reduction that contributes to improving the fuel efficiency of vehicles, the application of high strength steel sheets has been expanding. Since most components for a vehicle are manufactured by press forming, high strength and excellent formability are simultaneously required. In addition, for the purpose of securing the safety of occupants, an improvement of collision resistance is also desired, and a material having excellent bending deformation ability against bending stress generated at the time of a collision while having high strength is required. Therefore, there is demand for a material that is relatively soft and easily formed during forming, has a large bake hardening amount during baking for coating after forming, and has excellent bendability after bake hardening.

The bake hardening is a phenomenon in which interstitial elements (mainly carbon) are moved and locked to dislocations (line defects that are the elementary process of plastic deformation) that are formed by press forming (hereinafter, also referred to as "pre-strain") to impede the movement thereof and increase the strength, and is also called strain aging. The bake hardening amount can be controlled by the amount of solid solution carbon in a ferrite single phase structure such as low carbon steel sheet.

On the other hand, a large proportion of a high strength steel sheet is a composite structure containing a hard structure (martensite) and a soft structure (ferrite) in order to secure workability. Particularly, the hard structure (martensite) containing a large amount of solid solution carbon is responsible for high bake hardenability. However, although the hard structure containing a large amount of solid solution carbon can achieve high strength, it has been difficult to achieve both bake hardenability and bendability after bake hardening. That is, since martensite has a larger amount of solid solution carbon and a higher dislocation density compared to ferrite, martensite is excellent in bake hardenability, but is inferior in bendability.

For example, Patent Document 1 discloses a cold-rolled steel sheet that primarily contains a structure composed of bainite and martensite and secures high bake hardenability by limiting the area ratio of ferrite to 5% or less. However, since this steel sheet contains a large amount of hard structures such as bainite and martensite, when the pre-strain is 2% or more, bake hardening occurs in each of the hard phase and the soft phase in the composite structure. Therefore, the strength of the structure after the bake hardening treatment becomes non-uniform, and excellent bendability after bake hardening is not exhibited.

Patent Document 2 discloses a steel sheet having improved workability and bake hardenability by containing tempered martensite or tempered bainite. However, in Patent Document 2, no sufficient study has been made from the viewpoint of improving the bendability after bake hardening.

PRIOR ART DOCUMENT

Patent Document

[Patent Document 1] Japanese Unexamined Patent Application, First Publication No. 2008-144233

[Patent Document 2] Japanese Unexamined Patent Application, First Publication No. 2003-277884

DISCLOSURE OF THE INVENTION

Problems to be Solved by the Invention

Therefore, an object of the present invention is to provide a cold-rolled steel sheet having a high bake hardening amount and excellent bendability after bake hardening.

Means for Solving the Problem

In order to achieve the above object, the present inventors investigated the bake hardening amount and the bendability after bake hardening. As a result, the present inventors found that in a case where the structure of a cold-rolled steel sheet containing ferrite and tempered martensite has a crosslinked structure in which ferrite is finely and homogeneously divided in a rolling direction and a sheet thickness direction by tempered martensite, the cold-rolled steel sheet has a large bake hardening amount and is excellent in bendability after bake hardening. Furthermore, the present inventors found that such a crosslinked structure can be quantified by using a frequency spectrum obtained by performing a two-dimensional Fourier transformation on a microstructure image of the cold-rolled steel sheet, and completed the present invention.

The cold-rolled steel sheet which has achieved the above-mentioned object is as follows.

(1) A cold-rolled steel sheet is provided including, by mass %: C: 0.05% to 0.30%; Si: 0.200% to 2.000%; Mn: 2.00% to 4.00%; P: 0.100% or less; S: 0.010% or less; Al: 0.001% to 2.000%; N: 0.010% or less; Ti: 0% to 0.100%; Nb: 0% to 0.100%; V: 0% to 0.100%; Cu: 0% to 1.000%; Ni: 0% to 1.000%; Mo: 0% to 1.000%; Cr: 0% to 1.000%; W: 0% to 0.005%; Ca: 0% to 0.005%; Mg: 0% to 0.005%; REM: 0% to 0.010%; B: 0% to 0.0030%; and the remainder includes Fe and impurities, in which the cold-rolled steel sheet contains 20% or more and 70% or less of ferrite and 30% or more of tempered martensite in terms of area ratio, a sum of ferrite and tempered martensite is 90% or more, and in a case where in a sheet thickness cross section perpendicular to a sheet width direction of the steel sheet at a position from ⅛ to ⅞ of a sheet width of the cold-rolled steel sheet, a microstructure image of 30 μm×30 μm obtained by photographing a structure at a position from ¼ to ⅜ of a sheet thickness from a surface of the cold-rolled steel sheet at a magnification of 2,000-fold is disposed in an xy coordinate system having a sheet thickness direction as an x-axis and a rolling direction as a y-axis, the microstructure image is divided into 1024 pieces in an x-axis direction and 1024 pieces in a y-axis direction to form 1024×1024 divided regions, and a two-dimensional image is created by performing double gradation by assuming a value of "1" in each of the divided regions in one case where the structure is ferrite and assuming a value of "0" in the other cases, a heterogeneity α defined by Formula (1) for the two-dimensional image is 1.20 or less.

[Formula 1]

$$\alpha = \frac{S_u}{S_v} \tag{1}$$

In Formula (1), Su is defined by Formula (2), and Sv is defined by Formula (3).

[Formula 2]

$$S_u = \sum_{u=1}^{1023} \|F(u, 0)\| \tag{2}$$

$$S_v = \sum_{u=1}^{1023} \|F(0, v)\| \tag{3}$$

In Formula (2) and Formula (3), F(u,v) is defined by Formula (4).

[Formula 3]

$$F(u, v) = \sum_{x=0}^{1023} \sum_{y=0}^{1023} f(x, y) e^{-2\pi i\left(\frac{ux}{1024} + \frac{vy}{1024}\right)} \tag{4}$$

In Formula (4), f(x,y) represents a gradation of coordinates (x,y) of the two-dimensional image.

(2) The cold-rolled steel sheet according to (1), further including, by mass %, one or two or more of: Ti: 0.003% to 0.100%, Nb: 0.003% to 0.100%, and V: 0.003% to 0.100%, in a total amount of 0.100% or less.

(3) The cold-rolled steel sheet according to (1) or (2), in which the microstructure image is a microstructure image of 30 μm×30 μm obtained by photographing a structure at a position from ¼ to ⅜ of the sheet thickness from the surface of the cold-rolled steel sheet in a sheet thickness cross section perpendicular to the sheet width direction of the steel sheet at a center position of the sheet width of the cold-rolled steel sheet, at a magnification of 2,000-fold.

Effects of the Invention

According to the present invention, it is possible to provide a cold-rolled steel sheet having a composite structure which has a high bake hardening amount and excellent bendability after bake hardening by having a crosslinked structure in which ferrite is finely and homogeneously divided in a rolling direction and a sheet thickness direction by tempered martensite. This cold-rolled steel sheet has excellent press formability, is further high-strengthened by being baked during coating after press forming, and is also excellent in subsequent bendability. Therefore, the steel sheet has high impact absorption against bending stress generated during deformation into a bellows shape by receiving an impact force, and is thus suitable as a structural member in an automotive field.

EMBODIMENTS OF THE INVENTION

<Cold-Rolled Steel Sheet>

Figure 1:
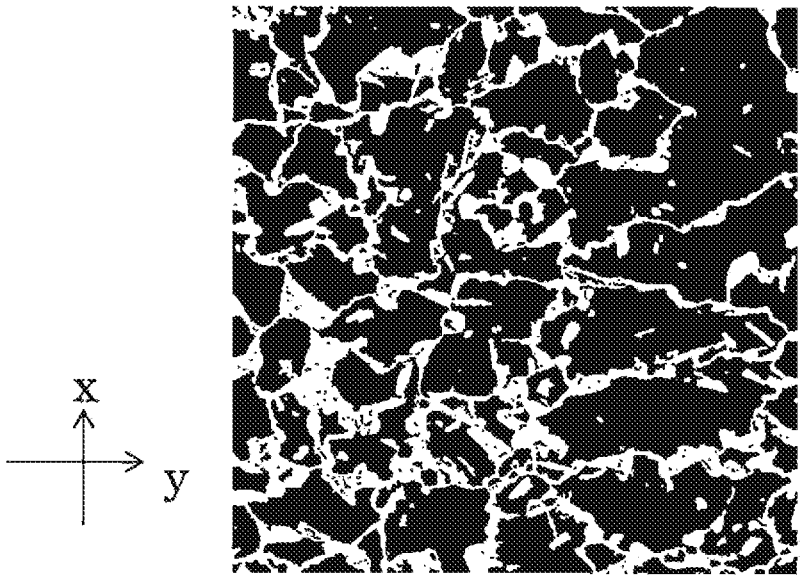
FIG. 1 is a two-dimensional image in which the microstructure of a cold-rolled steel sheet according to an embodiment of the present invention is subjected to double gradation.

A cold-rolled steel sheet according to an embodiment of the present invention includes, by mass %: C: 0.05% to 0.30%; Si: 0.200% to 2.000%; Mn: 2.00% to 4.00%; P: 0.100% or less; S: 0.010% or less; Al: 0.001% to 2.000%; N: 0.010% or less; Ti: 0% to 0.100%; Nb: 0% to 0.100%; V: 0% to 0.100%; Cu: 0% to 1.000%; Ni: 0% to 1.000%; Mo: 0% to 1.000%; Cr: 0% to 1.000%; W: 0% to 0.005%; Ca: 0% to 0.005%; Mg: 0% to 0.005%; REM: 0% to 0.010%; B: 0% to 0.0030%; and the remainder consisting of Fe and impurities, in which the cold-rolled steel sheet contains 20% or more and 70% or less of ferrite and 30% or more of tempered martensite in terms of area ratio, a sum of ferrite and tempered martensite is 90% or more, and in a case where in a sheet thickness cross section perpendicular to a sheet width direction of the steel sheet at a position from ⅛ to ⅞ of a sheet width of the cold-rolled steel sheet, a microstructure image of 30 μm×30 μm obtained by photographing a structure at a position from ¼ to ⅜ of a sheet thickness from a surface of the cold-rolled steel sheet at a magnification of 2,000-fold is disposed in an xy coordinate system having a sheet thickness direction as an x-axis and a rolling direction as a y-axis, the microstructure image is divided into 1024 pieces in an x-axis direction and 1024 pieces in a y-axis direction to font) 1024×1024 divided regions, and a two-dimensional image is created by performing double gradation by assuming a value of "1" in each of the divided regions in one case where the structure is ferrite and assuming a value of "0" in the other cases, and a heterogeneity α defined by Formula (1) for the two-dimensional image is 1.20 or less.

[Formula 4]

$$\alpha = \frac{S_u}{S_v} \tag{1}$$

In Formula (1), Su is defined by Formula (2), and Sv is defined by Formula (3).

[Formula 5]

$$S_u = \sum_{u=1}^{1023} \|F(u, 0)\| \tag{2}$$

$$S_v = \sum_{u=1}^{1023} \|F(0, v)\| \tag{3}$$

In Formula (2) and Formula (3), F(u,v) is defined by Formula (4).

[Formula 6]

$$F(u, v) = \sum_{x=0}^{1023} \sum_{y=0}^{1023} f(x, y) e^{-2\pi i\left(\frac{ux}{1024} + \frac{vy}{1024}\right)} \tag{4}$$

In Formula (4), f(x,y) represents a gradation of coordinates (x,y) of the two-dimensional image.

For example, in order to improve the bake hardenability of a steel sheet including a composite structure containing ferrite and martensite, it is necessary to homogeneously introduce pre-strain into both ferrite and martensite in the steel sheet, and from the viewpoint of improving the bendability after bake hardening, it is important to homogenize the structure of the steel sheet. In view of the above findings, in the steel sheet according to the present embodiment, the present inventors defined the heterogeneity α defined by the above formula to be 1.20 or less. The present inventors found that in a case where the heterogeneity α is 1.20 or less, the bake hardenability and the bendability after bake hardening of the cold-rolled steel sheet can be significantly improved.

In a case where the heterogeneity α is set to 1.20 or less in the cold-rolled steel sheet including the composite structure containing ferrite and tempered martensite, for example, a crosslinked structure in which ferrite is finely and homogenously divided in the rolling direction and the sheet thickness direction of the cold-rolled steel sheet is formed by tempered martensite. Here, "a crosslinked structure in which ferrite is finely and homogenously divided in the rolling direction and the sheet thickness direction of the cold-rolled steel sheet" is intended to be a structure in which tempered martensite is randomly connected inside the steel sheet so as to spread in the rolling direction and the sheet thickness direction of the steel sheet, and ferrite is finely and homogenously dispersed therein. This is because when the structure is observed from the cross section of the steel sheet including the sheet thickness direction x and the rolling direction y, there are a plurality of states in which the tempered martensite spreads over the same thickness regions, and these same thickness regions are connected in a random arrangement by parallel lines extending in the sheet thickness direction x (see FIG. 3). As a result, in the above cross section, ferrite is finely divided by tempered martensite. However, it should be noted that this crosslinked structure is only an example of the configuration of the structure of the steel sheet having a heterogeneity α of 1.20.

In order to obtain a structure having a heterogeneity α of 1.20 or less, it is necessary to control manufacturing conditions described later. Hereinafter, the quantification of the crosslinked structure by such Fourier transform will be described in detail.

First, using a scanning electron microscope (SEM), in a sheet thickness cross section perpendicular to the sheet width direction of the steel sheet at a position from ⅛ to ⅞ of the sheet width of the cold-rolled steel sheet, a microstructure image of 30 μm×30 μm is photographed at a position from ¼ to ⅜ of the sheet thickness from the surface in a grayscale (256 gradations) at an observation magnification of 2,000-fold. The obtained microstructure image is disposed in the xy coordinate system having the sheet thickness direction as the x-axis and the rolling direction as the y-axis, and has 1024×1024 pixels (corresponding to the divided region). Next, a two-dimensional image is created by performing double gradation by assuming a value of "1" in each of the 1024×1024 pixels in one case where the structure is ferrite and assuming a value of "0" in the other cases. In a specific embodiment of the present invention, the above microstructure image may be a microstructure image of 30 μm×30 μm obtained by photographing a structure at a position from ¼ to ⅜ of the sheet thickness from the surface in a sheet thickness cross section perpendicular to the sheet width direction of the steel sheet at a center position of the sheet width of the cold-rolled steel sheet, at a magnification of 2,000-fold.

The double gradation image processing can be performed using, for example, ImageJ, which is image analysis software. Each of the pixels is binarized so that the pixels become black in a case where the structure is ferrite and white otherwise. A threshold for binarization is determined using a method that adopts the average value of luminance values described in "Glasbey, C A (1993), "An analysis of histogram-based thresholding algorithms", CVGIP: Graphical Models and Image Processing 55: 532-537" as the threshold. This algorithm is implemented in ImageJ, and is automatically binarized by using the Auto threshold function and setting the thresholding method to Method=Mean. That is, the threshold for binarization is automatically determined from a smoothed histogram by replacing each pixel value with the average of pixel values within a radius of 15 pixels centered on the pixel of interest, with ImageJ where Method=Mean and radius=15 are set.

An example of the two-dimensional image thus obtained is shown in FIG. 1. FIG. 1 is a two-dimensional image in which the microstructure of the cold-rolled steel sheet according to the embodiment of the present invention is subjected to double gradation. The x-axis in FIG. 1 corresponds to the sheet thickness direction, and the y-axis corresponds to the rolling direction. In FIG. 1, black portions indicate ferrite and white portions indicate tempered martensite. As is clear from FIG. 1, it can be seen that the black ferrite phase is finely and homogeneously divided in the rolling direction and the sheet thickness direction of the cold-rolled steel sheet by the white tempered martensite phase, and a crosslinked structure is formed.

Next, two-dimensional data f(x,y) of each pixel (x,y) (x=0 to 1023, y=0 to 1023) is obtained from the two-dimensional image obtained by the double gradation. f(x,y) represents the gradation of the pixel at the coordinates (x,y). The obtained two-dimensional data is subjected to two-dimensional discrete Fourier transform (2D DFT) defined Formula (4).

[Formula 7]

$$F(u, v) = \sum_{x=0}^{1023} \sum_{y=0}^{1023} f(x, y) e^{-2\pi i\left(\frac{ux}{1024} + \frac{vy}{1024}\right)} \tag{4}$$

Here, F(u,v) is a two-dimensional frequency spectrum after the two-dimensional discrete Fourier transform of the two-dimensional data f(x,y). The frequency spectrum F(u,v) is generally a complex number and contains information on the periodicity and regularity of the two-dimensional data f(x,y). In other words, the frequency spectrum F(u,v) contains information on the periodicity and regularity of the structure of ferrite and tempered martensite in the two-dimensional image as shown in FIG. 1.

Figure 2:
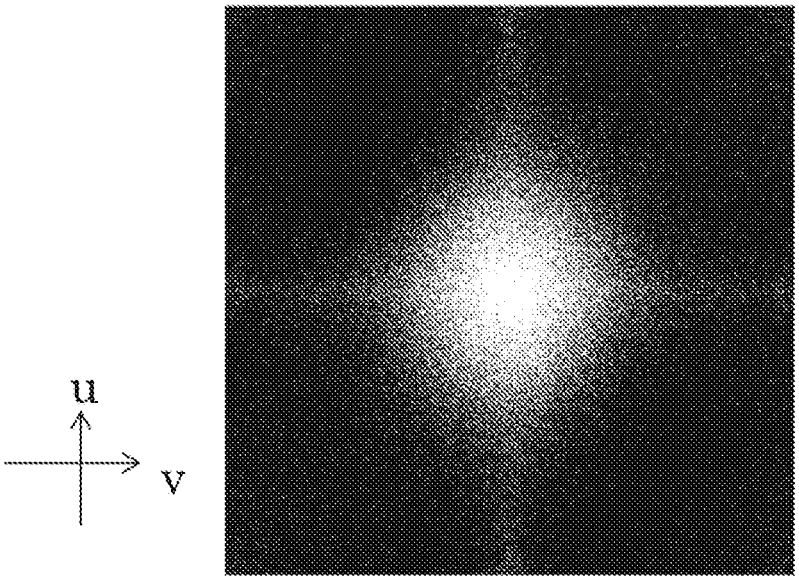
FIG. 2 is a frequency spectrum diagram obtained by performing a two-dimensional discrete Fourier transform on the two-dimensional image of FIG. 1.

FIG. 2 is a frequency spectrum diagram obtained by performing a two-dimensional discrete Fourier transform on the two-dimensional image of FIG. 1. The horizontal axis of FIG. 2 is a v-axis, the range thereof is v=−1023 to 1023, the vertical axis is a u-axis, and the range thereof is u=−1023 to 1023. The frequency spectrum diagram of FIG. 2 is a black-and-white gradation image (grayscale image), in which the maximum value of the spectral intensity is indicated as white and the minimum value is indicated as black. In FIG. 2, parts having a high spectral intensity (white portion in FIG. 2) have a shape extending from the central part in the v-axis and u-axis directions, and the boundary is not clear.

In the frequency spectrum F(u,v), the sum Su of the absolute values (that is, the spectral intensities) of the spectra on the u-axis is defined by Formula (2). Similarly, in the frequency spectrum F(u,v), the sum Sv of the absolute values of the spectra on the v-axis is defined by Formula (3). Furthermore, the ratio of Su to Sv is defined by Formula (1) and is referred to as heterogeneity α in the present invention. The sums of Formula (2) and Formula (3) that define Su and Sv do not include the absolute values of the spectra of coordinates (0,0) in a (u,v) space.

[Formula 8]

$$S_u = \sum_{u=1}^{1023} \|F(u, 0)\| \tag{2}$$

$$S_v = \sum_{u=1}^{1023} \|F(0, v)\| \tag{3}$$

$$\alpha = \frac{S_u}{S_v} \tag{1}$$

Hereinafter, the microstructure shown in FIG. 1 is referred to as a structure 1. As described above, the structure 1 has a crosslinked structure in which ferrite is divided by tempered martensite. In addition, in the frequency spectrum diagram (FIG. 2) of the structure 1, similarly as described above, the white portions have a shape extending from the central part of the image along the u-axis and v-axis directions.

Figure 3:
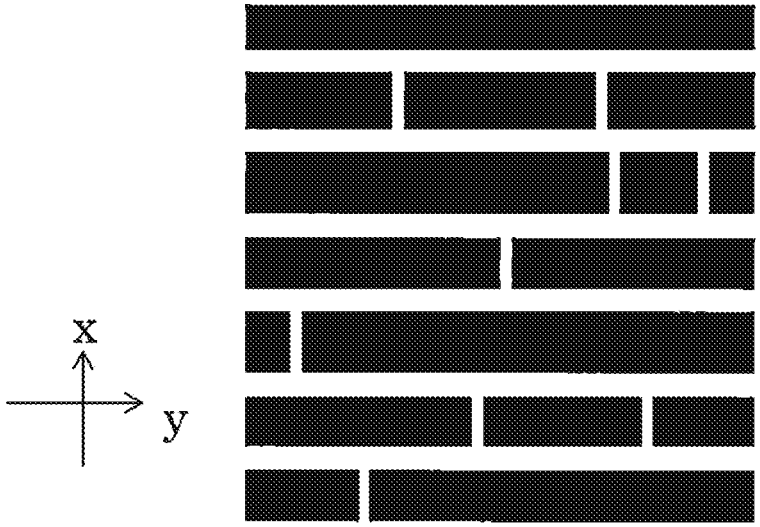
FIG. 3 is an exemplary schematic diagram of a two-dimensional image in which the microstructure of a cold-rolled steel sheet is subjected to double gradation.
Figure 4:
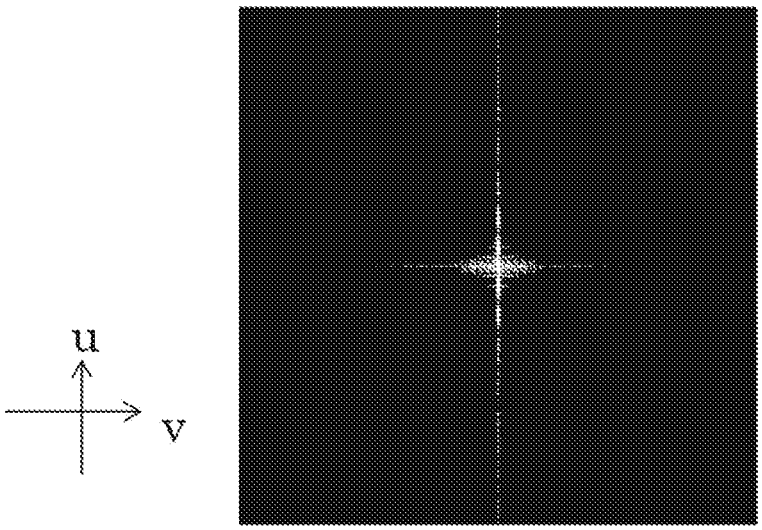
FIG. 4 is a frequency spectrum diagram obtained by performing a two-dimensional discrete Fourier transform on the two-dimensional image of FIG. 3.
Figure 5:
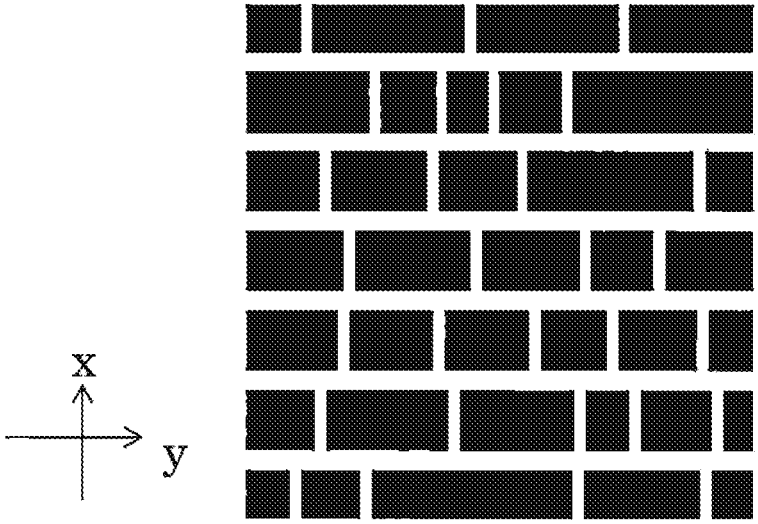
FIG. 5 is an exemplary schematic diagram of a two-dimensional image in which the microstructure of a cold-rolled steel sheet is subjected to double gradation.
Figure 6:
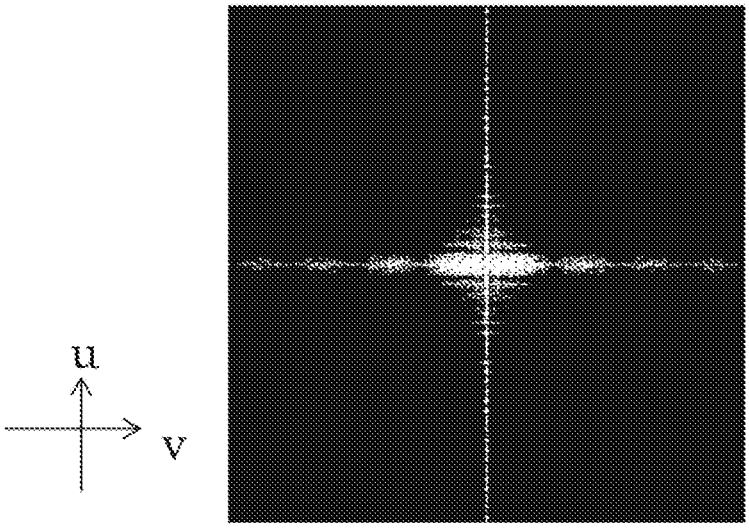
FIG. 6 is a frequency spectrum diagram obtained by performing a two-dimensional discrete Fourier transform on the two-dimensional image of FIG. 5.

In order to facilitate understanding, the relationship between the crosslinked structure and the frequency spectrum diagram as shown in FIGS. 1 and 2 will be described in detail below with reference to schematic diagrams (FIGS. 3 to 6). FIGS. 3 and 5 are exemplary schematic diagrams of two-dimensional images in which the microstructure of a cold-rolled steel sheet is subjected to double gradation. In FIGS. 3 and 5, black portions indicate ferrite and white portions indicate tempered martensite. FIGS. 4 and 6 are frequency spectrum diagrams obtained by performing a two-dimensional discrete Fourier transform on the two-dimensional images of FIGS. 3 and 5, respectively. Referring to FIGS. 3 and 5, it can be seen that the two-dimensional image of FIG. 5 has a crosslinked structure in which ferrite (black portions) is more finely and homogeneously divided by tempered martensite (white portions) compared to the two-dimensional image of FIG. 3. In addition, referring to FIGS. 4 and 6 which are frequency spectrum diagrams, in the frequency spectrum diagram of FIG. 4, the spread of white portions in the u-axis direction is more significant than the spread in the v-axis direction compared to the frequency spectrum diagram of FIG. 6. As a result, the heterogeneity α in FIG. 5 takes a lower value than in FIG. 3. In short, the lower the heterogeneity α, the less the difference between the spread of the white portions in the u-axis direction and the spread in the v-axis direction, that is, the structure of the cold-rolled steel sheet has a crosslinked structure that is divided more finely and homogeneously. Actually, when the heterogeneity α is calculated for the structure 1 according to the embodiment of the present invention in FIG. 1, the heterogeneity α is 1.14, which is controlled within the range of 1.20 or less.

The bake hardening amount of the structure 1 is 105 MPa, and similarly, the minimum bend radius after bake hardening/sheet thickness ratio of the structure 1 is 0.4. It can be evaluated that the smaller the minimum bend radius/sheet thickness ratio, the better the bendability after bake hardening. These values were measured under the same conditions as in examples, which will be described later.

Figure 7:
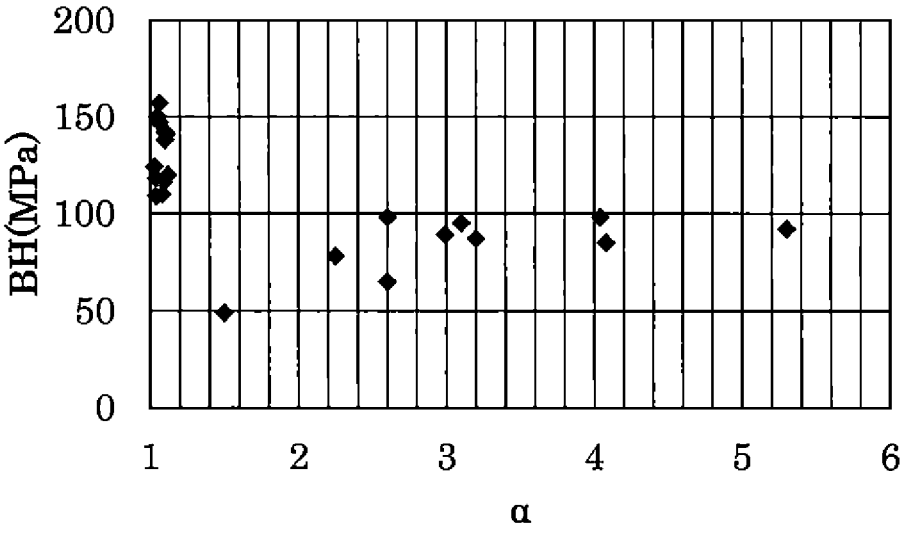
FIG. 7 is a graph showing the relationship between a heterogeneity α and a bake hardening amount BH.
Figure 8:
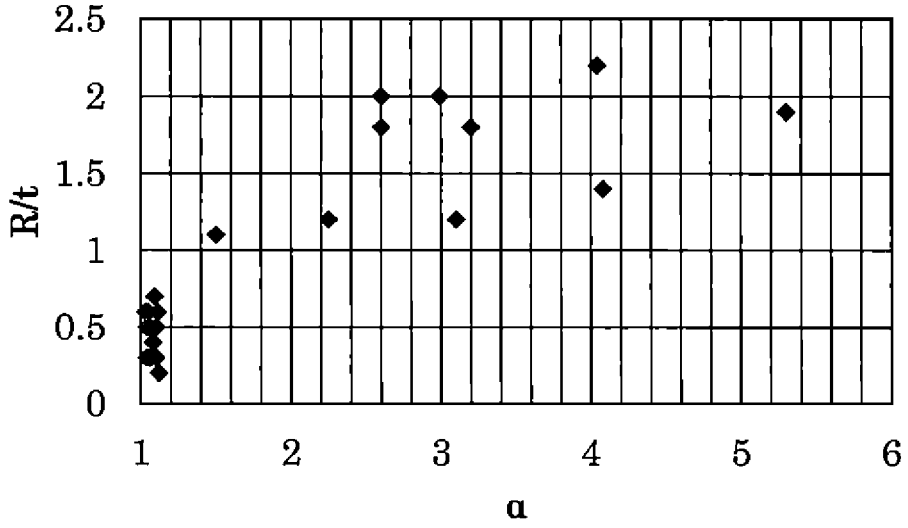
FIG. 8 is a graph showing the relationship between a heterogeneity α and RA, which is the ratio of a minimum bend radius after bake hardening to a sheet thickness.

FIG. 7 is a graph showing the relationship between the heterogeneity α and the bake hardening amount BH. FIG. 8 is a graph showing the relationship between the heterogeneity α and R/t, which is the ratio of the minimum bend radius after bake hardening to the sheet thickness. FIGS. 7 and 8 are plots of data obtained by manufacturing a plurality of cold-rolled steel sheets having a chemical composition and a structure within the ranges of the embodiment of the present invention described above and having different a, and then performing the same bake hardening treatment and bending test as in the examples on the cold-rolled steel sheets. Referring to FIGS. 7 and 8, it can be seen that when α becomes small, particularly when α becomes 1.20 or less, the bake hardening amount BH is greatly improved, and R/t, which is the ratio of the minimum bend radius after bake hardening to the sheet thickness, tends to decrease significantly. The result shows that by forming a crosslinked structure, which is a crosslinked structure in which ferrite is finely and homogeneously divided in the rolling direction and the sheet thickness direction of the cold-rolled steel sheet by tempered martensite and α is 1.20 or less, in the cold-rolled steel sheet including the composite structure containing ferrite and tempered martensite, the bake hardenability and the bendability after bake hardening of the cold-rolled steel sheet can be significantly improved.

Hereinafter, an example of the embodiment of the present invention will be described.

(I) Chemical Composition

First, the chemical composition of the steel sheet according to the embodiment of the present invention and a slab used for the manufacturing thereof will be described. In the following description, "%", which is the unit of the amount of each element contained in the steel sheet and the slab, means "mass %" unless otherwise specified.

(C: 0.05% to 0.30%)

C has an action of enhancing hardenability and increasing strength by being contained in a martensite structure. C also has an action of increasing the bake hardenability. In order to effectively exhibit the above actions, the C content is set to 0.05% or more, preferably 0.07% or more, and more preferably 0.09% or more. On the other hand, when the C content is more than 0.30%, weldability deteriorates. Therefore, the C content is set to 0.30% or less, preferably 0.20% or less, and more preferably 0.14% or less.

(Si: 0.200% to 2.000%)

Si is an element necessary for securing solid solution C, which suppresses the generation of carbides and is required for bake hardening. When the Si content is less than 0.200%, a sufficient effect may not be obtained. Therefore, the Si content is set to 0.200% or more. Si is also useful for high-strengthening of steel sheets having excellent bake hardening. In order to effectively exert this action, the Si content is set to preferably 0.500% or more, and more preferably 0.800% or more. On the other hand, when the Si content is more than 2.000%, surface properties deteriorate or the effect of adding Si is saturated, resulting in an unnecessary increase in cost. Therefore, the Si content is set to 2.000% or less, preferably 1.500% or less, and more preferably 1.100% or less.

(Mn: 2.00% to 4.00%)

Mn is an element that improves hardenability and is useful for high-strengthening of steel sheets. In order to effectively exhibit such an action, the Mn content is set to 2.00% or more, preferably 2.30% or more, and more preferably 2.60% or more. However, singe an excessive addition of Mn reduces low temperature toughness due to the precipitation of MnS, the Mn content is set to 4.00% or less, preferably 3.50% or less, and more preferably 3.00% or less.

(Al: 0.001% to 2.000%)

Al has an effect on deoxidizing and improving the yield of carbide-forming elements. In order to effectively exhibit the above action, the Al content is set to 0.001% or more, preferably 0.010% or more, and more preferably 0.020% or more. On the other hand, when the Al content is more than 2.000%, the weldability decreases or oxide-based inclusions are increased in amount, resulting in the deterioration of surface properties. Therefore, the Al content is set to 2.000% or less, preferably 1.000% or less, and more preferably 0.030% or less.

(P: 0.100% or Less)

P is not an essential element, but is contained, for example, as an impurity in steel. From the viewpoint of weldability, the lower the P content, the better. In particular, when the P content is more than 0.100%, a reduction in weldability is significant. Therefore, the P content is set to 0.100% or less, preferably 0.030% or less, and more preferably 0.020% or less. It takes a cost to reduce the P content, and a reduction in the P content to less than 0.0001% causes a significant increase in the cost. Therefore, the P content may be set to 0.0001% or more, or 0.010% or more. Furthermore, since P contributes to an improvement in strength, the P content may be set to 0.0001% or more or 0.010% or more from such a viewpoint.

(S: 0.010% or Less)

S is not an essential element, but is contained, for example, as an impurity in steel. From the viewpoint of weldability, the lower the S content, the better. As the S content increases, the amount of MnS precipitated increases, and the low temperature toughness decreases. In particular, when the S content is more than 0.010%, a reduction in the weldability and a reduction in the low temperature toughness are significant. Therefore, the S content is set to 0.010% or less, preferably 0.007% or less, and more preferably 0.003% or less. It takes a cost to reduce the S content, and a reduction in the S content to less than 0.0001% causes a significant increase in the cost. Therefore, the S content may be set to 0.0001% or more, or 0.003% or more.

(N: 0.010% or Less)

N is not an essential element, but is contained, for example, as an impurity in steel. From the viewpoint of weldability, the lower the N content, the better. In particular, when the N content is more than 0.010%, a reduction in the weldability is significant. Therefore, the N content is set to 0.010% or less, preferably 0.006% or less, and more preferably 0.003% or less. It takes a cost to reduce the N content, and a reduction in the N content to less than 0.0001% causes a significant increase in the cost. Therefore, the N content may be set to 0.0001% or more.

The basic composition of the steel sheet according to the embodiment of the present invention and the slab used for the manufacturing thereof is as described above. The steel sheet and the slab may further contain the following optional elements, if necessary.

(Ti: 0.100% or Less, Nb: 0.100% or Less, and V: 0.100% or Less)

Ti, Nb, and V contribute to an improvement in strength. Therefore, Ti, Nb, V, or any combination thereof may be contained. In order to sufficiently obtain this effect, the amount of Ti, Nb, or V, or the total amount of any combination of two or more thereof is preferably set to 0.003% or more, and more preferably 0.010% or more. On the other hand, when the amount of Ti, Nb, or V or the total amount of any combination of two or more thereof is more than 0.100%, it becomes difficult to perform hot rolling and cold rolling. Therefore, the amount of Ti, the amount of Nb, the amount of V, or the total amount of any combination of two or more thereof is set to 0.100% or less, and more preferably 0.030% or less. That is, it is preferable that the limit range in the case of including each element alone is set to Ti: 0.003% to 0.100%, Nb: 0.003% to 0.100%, and V: 0.003% to 0.100%, and the total amount thereof in the case of any combination thereof is also set to 0.003% to 0.100%.

(Cu: 1.000% or Less, Ni: 1.000% or Less, Mo: 1.000% or Less, and Cr: 1.000% or Less)

Cu, Ni, Mo, and Cr contribute to an improvement in strength. Therefore, Cu, Ni, Mo, Cr, or any combination thereof may be contained. In order to sufficiently obtain this effect, the amount of Cu, Ni, Mo, and Cr is preferably in a range of 0.005% to 1.000%, and more preferably 0.010% to 1.000% in the case of including each element alone. In addition, the total amount in the case of any combination of two or more selected from the group consisting of Cu, Ni, Mo, and Cr preferably satisfies 0.005% or more and 1.000% or less, and more preferably 0.010% or more and 1.000% or less. On the other hand, when the amount of Cu, Ni, Mo, and Cr or the total amount in the case of any combination of two or more thereof is more than 1.000%, the effect due to the above-mentioned action is saturated and causes an increase in the cost. Therefore, the upper limit of the amount of Cu, Ni, Mo, and Cr or the total amount in the case of any combination of two or more thereof is set to 1.000%. That is, it is preferable that Cu: 0.005% to 1.000%, Ni: 0.005% to 1.000%, Mo: 0.005% to 1.000%, and Cr: 0.005% to 1.000% are set, and the total amount in the case of any combination thereof is 0.005% to 1.000%.

(W: 0.005% or Less, Ca: 0.005% or Less, Mg: 0.005% or Less, and REM: 0.010% or Less)

W, Ca, Mg, and REM contribute to the fine dispersion of inclusions and enhance toughness. Therefore, W, Ca, Mg, or REM or any combination thereof may be contained. In order to sufficiently obtain this effect, the total amount of W, Ca, Mg, and REM, or any combination of two or more thereof is set to preferably 0.0003% or more, and more preferably 0.003% or more. On the other hand, when the total amount of W, Ca, Mg, and REM is more than 0.010%, the surface properties deteriorate. Therefore, the total amount of W, Ca, Mg, and REM is set to 0.010% or less, and more preferably 0.009% or less. That is, it is preferable that W: 0.005% or less, Ca: 0.005% or less, Mg: 0.005% or less, and REM: 0.01% or less are set, and the total amount of any two or more thereof is 0.0003% to 0.010%. It is more preferable that the upper limit of the total amount of any two or more thereof is 0.009%, and it is more preferable that the lower limit of the total amount of any two or more thereof is 0.003%.

REM (rare earth metal) refers to a total of 17 elements including Sc, Y, and lanthanoids, and "REM content" means the total amount of these 17 elements. Lanthanoids are added industrially, for example, in the form of mischmetal.

(B: 0.0030% or Less)

B is an element that improves hardenability and is an element useful for high-strengthening of steel sheets. B may be contained in 0.0001% (1 ppm) or more. However, when B is added in more than 0.0030% (30 ppm), the above effect is saturated and it is economically useless. Therefore, the B content is set to 0.0030% (30 ppm) or less, preferably 0.0025% (25 ppm) or less, and more preferably 0.0019% (19 ppm) or less.

In the steel sheet according to the embodiment of the present invention, the remainder other than the above elements consists of Fe and impurities. The impurities are elements that are incorporated in due to various factors in a manufacturing process, including raw materials such as ores and scraps, when industrially manufacturing the steel sheet, and are not intentionally added to the steel sheet according to the present embodiment.

(II) Steel Structure

The cold-rolled steel sheet according to the embodiment of the present invention has a great feature in that a composite structure containing at least two or more structures is included, and by controlling the composite structure, the distribution of pre-strain is changed and the bake hardenability is improved. The reason for defining the area ratio for each of the structures will be described. In the following description, "%", which is the unit of the fraction of each structure contained in the steel sheet, means "area %" unless otherwise specified.

(Ferrite: 20% or More and 70% or Less)

Ferrite is a structure having a low yield stress, excellent ductility, and work hardening properties. Therefore, when the area ratio of ferrite is excessively increased, the strength before the bake hardening treatment is increased, and the yield stress after the bake hardening treatment is lowered. In this case, since the bake hardenability is significantly deteriorated, the area ratio of ferrite in the steel sheet is set to 70% or less. In order to further increase the bake hardenability, the area ratio of ferrite is set to preferably 50% or less, and more preferably 45% or less. On the other hand, when the area ratio of ferrite is less than 20%, pre-strain is excessively applied to the hard structure, which conversely deteriorates the bake hardenability and makes it impossible to obtain good ductility. Therefore, the area ratio of ferrite is set to 20% or more, preferably 25% or more, and more preferably 30% or more.

(Tempered Martensite: 30% or More)

In the embodiment of the present invention, in addition to ferrite mentioned above, tempered martensite is contained in an amount of 30% or more. Tempered martensite is a structure that enhances the strength, bake hardenability, and bendability after bake hardening of a steel sheet. In general, since the carbon concentration is higher in the hard structure than in ferrite, the bake hardenability is excellent. In the embodiment of the present invention, such a hard structure needs to be tempered martensite in order to increase the bake hardening amount, and as-quenched martensite in the composite structure needs to be tempered in order to improve the bendability after bake hardening and ultimate deformability. However, in a case where there are soft ferrite and tempered martensite as the composite structure, ferrite is responsible for most of the pre-strain, so that the bake hardenability of tempered martensite has not been fully utilized in the related art. In order to improve the bake hardenability, it is important to let tempered martensite be responsible for deformation. However, when the amount of tempered martensite is too small, only the ferrite is responsible for deformation. Therefore, the amount of tempered martensite needs to be 30% or more. Therefore, the area ratio of tempered martensite is set to 30% or more, preferably 40% or more, and more preferably 50% or more. On the other hand, the area ratio of tempered martensite is set to preferably 80% or less, and more preferably 70% or less.

(Sum of Ferrite and Tempered Martensite: 90% or More)

In the embodiment of the present invention, the sum of the area ratios of ferrite and tempered martensite is set to 90% or more. When the sum of the area ratios of ferrite and tempered martensite is less than 90%, a sufficient bake hardening amount and bendability after bake hardening cannot be obtained. Therefore, the sum of the area ratios of ferrite and tempered martensite is set to 90% or more, preferably 95% or more, more preferably 97% or more, and may be 100%.

(Other Structures)

In a preferred method of manufacturing the cold-rolled steel sheet of the present invention, which will be described later, there are cases where residual austenite is produced depending on the manufacturing conditions. The area ratio of this structure is obtained by subtracting the area ratios of ferrite and tempered martensite measured as described above from 100%. In the embodiment of the present invention, distribution control of pre-strain into ferrite and tempered martensite is important. Therefore, in a case where the amount of other structures, that is, structures such as residual austenite, is small, the effect thereof can be ignored. As described above, in the embodiment of the present invention, since 90% or more, preferably 95% or more of the structure is composed of ferrite and tempered martensite, the influence of residual austenite can be ignored.

Similarly, in the preferred method of manufacturing the cold-rolled steel sheet of the present invention, which will be described later, carbides such as cementite are precipitated from martensite and ferrite during a tempering step. Since such carbides precipitate finely in a large amount, it is difficult to measure the carbides in terms of area ratio. Therefore, in a case where ferrite and tempered martensite contain carbides, the area ratio of this structure is measured as the area ratio of a primary phase containing the carbides.

In the present invention, the area ratio of ferrite and the area ratio of tempered martensite are determined as follows.

First, a sample is taken with a sheet thickness cross section perpendicular to a rolling direction of a steel sheet as an observed section, the observed section is polished, the structure thereof at a thickness ¼ position of the steel sheet is observed with a scanning electron microscope with an electron backscatter diffractometer (SEM-EBSD) at a magnification of 5,000-fold, the resultant is subjected to image analysis in a visual field of 100 μm×100 μm to measure the area ratio of ferrite, and the average of values measured at any five or more visual fields is determined as the area ratio of ferrite in the present invention.

Next, an SEM secondary electron image of a region at a depth from 3t/8 to t/2 from the surface of the steel sheet is photographed. At this time, for example, the magnification is set to 1,500-fold. Since white portions of the obtained image data are hard structures and black portions are ferrite, the area ratio of the hard structures is determined based on the image data. The tempered state of the hard structure is determined as follows. When the SEM secondary electron image is observed, in a case where the contrast of laths and blocks contained in martensite is clear or fine carbides are precipitated in the structure when observed at 5,000-fold or 10,000-fold, it can be said that the structure is tempered, that is, the corresponding hard structure is determined to be tempered martensite.

(Heterogeneity α)

The cold-rolled steel sheet of the present embodiment has a heterogeneity α defined by Formula (1) of 1.20 or less. The heterogeneity α is obtained by the following method. In a sheet thickness cross section perpendicular to the sheet width direction of the steel sheet at a position from ⅛ to ⅞ of the sheet width of the cold-rolled steel sheet, a structure at a position from ¼ to ⅜ of the sheet thickness from the surface is photographed at a magnification of 2,000-fold. The obtained microstructure image of 30 μm×30 μm is disposed in an xy coordinate system having the sheet thickness direction as an x-axis and the rolling direction as a y-axis, and each of 1024×1024 pixels is represented in a grayscale. Therefore, the microstructure image represented in the grayscale (256 gradations) is obtained from the cross section of the cold-rolled steel sheet on the surface including the sheet thickness direction and the rolling direction. Next, a two-dimensional image is created by performing double gradation by assuming "1" in each of the 1024×1024 divided regions in one case where the structure is ferrite and assuming "0" in the divided region in the other cases. Last, the heterogeneity α defined by Formula (1) is obtained from the double gradation microstructure image using a two-dimensional discrete Fourier transform. In a specific embodiment of the present invention, the above microstructure image may be a microstructure image of 30 μm×30 μm obtained by photographing a structure at a position from ¼ to ⅜ of the sheet thickness from the surface in a sheet thickness cross section perpendicular to the sheet width direction of the steel sheet at a center position of the sheet width of the cold-rolled steel sheet, at a magnification of 2,000-fold.

[Formula 9]

$$\alpha = \frac{S_u}{S_v} \tag{1}$$

In Formula (1), Su is defined by Formula (2), and Sv is defined by Formula (3).

[Formula 10]

$$S_u = \sum_{u=1}^{1023} \|F(u, 0)\| \tag{2}$$

$$S_v = \sum_{u=1}^{1023} \|F(0, v)\| \tag{3}$$

In Formula (2) and Formula (3), F(u,v) is defined by Formula (4).

[Formula 11]

$$F(u, v) = \sum_{x=0}^{1023} \sum_{y=0}^{1023} f(x, y) e^{-2\pi i\left(\frac{ux}{1024} + \frac{vy}{1024}\right)} \tag{4}$$

In Formula (4), f(x,y) represents a gradation of coordinates (x,y) of the two-dimensional image.

As described above, a and the bake hardenability have the relationship shown in FIG. 7, and α and the bendability after bake hardening have the relationship shown in FIG. 8. In the cold-rolled steel sheet according to the embodiment of the present invention, when α obtained from the structure is 1.20 or less, as shown in FIGS. 7 and 8, the bake hardening amount BH becomes 100 MP or more, and R/t, which is the ratio of the minimum bend radius after bake hardening to the sheet thickness becomes less than 1.0. Therefore, the cold-rolled steel sheet according to the embodiment of the present invention has excellent bake hardenability and impact resistance. α is preferably 1.10 or less, and more preferably 1.05 or less. The lower limit of α is not particularly specified, but is generally 0.90 or more.

From the above description, the cold-rolled steel sheet according to the embodiment of the present invention has excellent bake hardening performance for coating and excellent impact resistance. Therefore, the cold-rolled steel sheet of the present embodiment is preferably used for a structural member of a vehicle and the like, which is press-formed to be used.

(Mechanical Properties)

The cold-rolled steel sheet according to the present embodiment has a tensile strength of preferably 780 MPa or more, more preferably 800 MPa or more, and even more preferably 900 MPa or more.

The cold-rolled steel sheet according to the present embodiment has a bake hardening amount of preferably 100 MPa or more, more preferably 120 MPa or more, and even more preferably 150 MPa or more.

The cold-rolled steel sheet according to the present embodiment has a fracture elongation of preferably 10% or more, and more preferably 12% or more. The cold-rolled steel sheet according to the present embodiment has excellent bendability after bake hardening, and has a minimum bend radius/sheet thickness ratio of preferably less than 1.0, and more preferably 0.5 or less.

(III) Manufacturing Method

Next, a preferred manufacturing method of a cold-rolled steel sheet according to the embodiment of the present invention will be described.

The following description is intended to exemplify the characteristic method for manufacturing the cold-rolled steel sheet according to the embodiment of the present invention, and is not intended to limit the cold-rolled steel sheet to be manufactured by the manufacturing method described below.

The manufacturing method is characterized by including: a step of forming a slab by casting a molten steel having the chemical composition described above; a rough rolling step of performing rough rolling on the slab in a temperature range of 1050° C. or higher and 1250° C. or lower, in which the rough rolling is performed by reverse rolling having a rolling reduction of 30% or less per pass, the reverse rolling includes three or more sets of rolling with a total of two reciprocations as one set, the two reciprocations including the following (i) and (ii): (i) one reciprocation with a rolling reduction of 20% or more and 30% or less in a first pass and a rolling reduction of 15% or less in a second pass; and (ii) one reciprocation with a rolling reduction of 15% or less in a third pass and a rolling reduction of 20% or more and 30% or less in a fourth pass, and the difference in the rolling reduction between two passes during one reciprocation is 5% or more; a finish rolling step of performing finish rolling on the rough-rolled steel sheet in a temperature range of 850° C. or higher and 1050° C. or lower, the finish rolling step being started shorter than five seconds after the rough rolling step, in which finish rolling is performed by four or more continuous rolling stands, the rolling reduction of the first stand is less than 15%, and the finish-rolled steel sheet is wound in a temperature range of 200° C. or lower; a cold rolling step of performing cold rolling on the obtained hot-rolled steel sheet at a rolling reduction of 30% or less; an annealing step of holding the obtained cold-rolled steel sheet in a temperature range of $Ac_1$ or higher and 1000° C. or lower for 10 seconds or longer and 1,000 seconds or shorter, and cooling the resultant to 200° C. or lower at an average cooling rate of 10° C./s or faster and 200° C./s or slower; and a tempering step of holding the obtained steel sheet in a temperature range of 200° C. or higher and 350° C. or lower for 100 seconds or longer. Hereinafter, each step will be described.

(Step of Forming Slab)

The slab can be manufactured by melting the molten steel having the chemical composition of the steel sheet according to the embodiment of the present invention described above using, for example, a converter or an electric furnace, by a continuous casting method. Instead of the continuous casting method, an ingot-making method, a thin slab casting method, or the like may be adopted.

(Rough Rolling Step)

The slab may be heated to a temperature range of 1000° C. or higher and 1300° C. or lower before performing the following rough rolling step. A retention time after the heating is not particularly specified, but is preferably set to 30 minutes or longer in order to cause the central part of the slab to achieve a predetermined temperature. In addition, in order to suppress excessive scale loss, the retention time is set to preferably 10 hours or shorter, and more preferably 5 hours or shorter. In a case where direct-feed rolling or direct rolling is performed and the temperature of the slab after the casting is 1050° C. or higher and 1250° C. or lower, the slab may be directly subjected to the following rough rolling step without being subjected to heating and holding.

By performing rough rolling using only reverse rolling, it is possible to control a Mn segregation portion in the slab into a complicated shape without forming a plate shape stretched in one direction. Therefore, in a subsequent step, the formation of a banded structure is suppressed, and a structure in which ferrite is complicatedly intricate can be obtained. As a result, a cold-rolled steel sheet which is controlled to a heterogeneity $\alpha$ of 1.20 or less and includes a composite structure having a crosslinked structure in which ferrite is finely and homogeneously divided by tempered martensite can be finally obtained. Since a cold-rolled steel sheet including a composite structure in the related art is not subjected to reverse rolling with a rolling reduction difference in one reciprocation as described below, the heterogeneity $\alpha$ cannot be set to 1.20 or less.

The formation of the Mn segregation portion into a complicated shape will be described in more detail. First, in a slab before starting rough rolling, a plurality of portions where alloying elements such as Mn are concentrated grow substantially perpendicularly in a comb-like form from both surfaces toward the inside of the slab and are in a state of being arranged. On the other hand, in the rough rolling, the surface of the slab is elongated in a direction in which rolling proceeds in each rolling pass. The direction in which rolling proceeds is a direction in which the slab travels with respect to rolling rolls. As the surface of the slab is thus stretched in the direction in which rolling proceeds, the Mn segregation portion growing toward the inside from the surface of the slab is inclined in the direction in which the slab travels in each rolling pass.

In the case of so-called unidirectional rolling in which the direction in which the slab travels in each pass of the rough rolling is always the same direction, the inclination of the Mn segregation portion gradually increases in the same direction in each pass while the Mn segregation portion maintains a substantially straight state. At the end of the rough rolling, the Mn segregation portion is in a posture substantially parallel to the surface of the slab while maintaining a substantially straight state, and flat microsegregation is formed.

On the other hand, in the case of reverse rolling in which the directions in which the slab travels in the respective passes of the rough rolling alternately become opposite directions, the Mn segregation portion inclined in the immediately preceding pass is inclined in the reverse direction in the subsequent pass, and as a result, the Mn segregation portion has a bent shape. Therefore, in the reverse rolling, passes alternately performed in opposite directions are repeatedly performed, whereby the Mn segregation portion has a complicatedly bent shape.

When the temperature of the rough rolling is lower than 1050° C., it is difficult to complete the rolling at a temperature of 850° C. or higher in the subsequent finish rolling step, and the shape of the steel sheet becomes defective. When the temperature is more than 1250° C., scale loss during slab preheating increases, which causes slab cracking. Therefore, the temperature of the rough rolling is set to 1050° C. or higher and 1250° C. or lower. The lower limit of the temperature of the rough rolling is preferably 1100° C. The upper limit of the temperature of the rough rolling is preferably 1200° C.

When the rolling reduction of one pass in the rough rolling is more than 30%, the shear stress during the rolling increases, so that the Mn segregation portions are easily distributed in a band shape and cannot be distributed in a complicated shape. Therefore, the rolling reduction of one pass in the rough rolling is set to 30% or less. The smaller the rolling reduction, the smaller the shear strain at the time of rolling, and the formation of a band structure is suppressed. Therefore, although the lower limit of the rolling reduction is not particularly specified, the lower limit of the rolling reduction is preferably 10% or more, and more preferably 15% from the viewpoint of productivity.

In order to make the Mn segregation portion into a complicated shape, more specifically, a mesh shape, and as a result, to obtain a crosslinked structure of tempered martensite and ferrite, the rolling reduction in each pass has to be controlled in order to change the shear stress during rolling. In order to make it difficult for the Mn segregation portion to be distributed in a band shape, it is preferable to repeat reciprocations of reverse rolling with different rolling reductions twice. At this time, it is preferable that the rolling reductions of the first pass and the fourth pass are set to be higher than those of the other passes so that the Mn segregation portion is distributed in a band shape by performing a large reduction in the same direction as the traveling direction in the first pass in which the rolling temperature is high and the Mn segregation portion is distributed in a complicated shape by performing a large reduction in the opposite direction to the traveling direction in the fourth pass in which the rolling temperature is low. That is, for rolling, three or more sets of rolling with a total of two reciprocations of the following (i) and (ii) as one set are performed: (i) one reciprocation with a rolling reduction of 20% or more and 30% or less in the first pass and a rolling reduction of 15% or less in the second pass; and (ii) one reciprocation with a rolling reduction of 15% or less in a third pass and a rolling reduction of 20% or more and 30% or less in a fourth pass.

However, when six or more sets of the above rolling are performed, it is difficult to secure a sufficient finish rolling temperature. Therefore, five or less sets are preferably performed.

Furthermore, it is desirable that passes of which the traveling directions are opposite to each other are performed the same number of times, that is, the total number of passes is an even number. However, in a general rough rolling line, the inlet side and the outlet side of the rough rolling are located on opposite sides with rolls therebetween. Therefore, the number of passes (rolling) in the direction from the inlet side to the outlet side of the rough rolling is larger by one. Then, in the last pass (rolling), the Mn segregation portion has a plate shape and it is difficult to form a mesh-like distribution of Mn. In a case where rough rolling is performed in such a hot rolling line, it is preferable that the rolling reduction when the rough-rolled sheet is finally sent from the inlet side to the outlet side is 5% or less, and it is more preferable to leave a gap between the rolls and omit rolling.

As will be described later, although tandem multi-stage rolling in the finish rolling is effective for refining a recrystallization structure, tandem rolling facilitates the formation of flat microsegregation. In order to utilize the tandem multi-stage rolling, the difference in rolling reduction in one reciprocation of the reverse rolling has to be large, and microsegregation formed in the subsequent tandem rolling has to be controlled. The effect becomes significant when the difference in rolling reduction in one reciprocation of the reverse rolling is 5% or more. Therefore, the difference in rolling reduction in one reciprocation of the reverse rolling is set to preferably 5% or more, and more preferably 10% or more.

In order to maintain a network structure of Mn produced by the reverse rolling in the rough rolling, it is necessary to suppress the austenite grain boundary migration. Therefore, the retention time from the rough rolling to the finish rolling is set to preferably shorter than five seconds, and more preferably three seconds or shorter.

(Finish Rolling Step)

After the reverse rolling in the rough rolling, in order to narrow the spacing of Mn segregation zones caused by secondary dendrite arms by increasing the rolling reduction of the tandem rolling in the finish rolling, the finish rolling is preferably performed by four or more continuous rolling stands. When the finish rolling is completed at lower than 850° C., recrystallization does not sufficiently occur, a structure elongated in the rolling direction is formed, and a plate-like structure due to the elongated structure is generated in a subsequent step. Therefore, a finish rolling completion temperature is set to 850° C. or higher, and preferably 900° C. or higher. On the other hand, when the finish rolling temperature is more than 1050° C., it becomes difficult to generate fine austenite recrystallized grains, Mn segregation at grain boundaries becomes difficult, and the Mn segregation zones are likely to be flat. Therefore, the finish rolling temperature is set to 1050° C. or lower. As necessary, the steel sheet subjected to the rough rolling may be reheated after the rough rolling step and before the finish rolling step. Furthermore, by setting the rolling reduction of the first stand of the finish rolling to less than 15% and suppressing the generation of a large amount of recrystallized grains, it becomes easy to maintain the network structure of Mn formed in the rough rolling step. As described above, by limiting not only the rough rolling step but also the finish rolling step, it is possible to suppress the flat Mn microsegregation. Furthermore, the rolling reduction of the first stand of the finish rolling is preferably 10% or less.

A coiling temperature is preferably 200° C. or lower. By setting the coiling temperature to 200° C. or lower, austenite transforms into hard martensite during cooling, and the introduction of transformation strain at that time introduces a large amount of strain into the soft ferrite near martensite, which contributes to refinement and homogenization of recrystallized ferrite by the subsequent annealing. When the coiling temperature is more than 200° C., the generation of martensite is suppressed, so that the above effect cannot be obtained and the heterogeneity $\alpha$ does not satisfy the conditions specified in the present invention. Therefore, the coiling temperature is 200° C. or lower, preferably 100° C. or lower, and more preferably 50° C. or lower. By performing cold rolling on the structure obtained by setting the coiling temperature to 200° C. or lower, stress is concentrated on ferrite near hard martensite, and a large amount of strain is introduced. By performing annealing in this state, a large number of recrystallized ferrite nuclei are generated, and a homogeneous and fine structure can be obtained. In addition, reverse transformation y is also finely generated between martensitic laths. In addition to the Mn network structure formed in the rough rolling step, martensite finely divides ferrite by the effects of the two, and a crosslinked structure is achieved, whereby the structure specified in the present invention is obtained. For bendability, both work effectiveness and ultimate deformability need to be excellent. By finely dividing ferrite by martensite and achieving a crosslinked structure, the work hardening ability of ferrite is improved, and furthermore, ultimate deformability for a homogeneous structure is also excellent.

On the other hand, since hard martensite is not generated by high-temperature coiling at higher than 200° C., the amount of strain introduced into ferrite after cold rolling is smaller than that of low-temperature coiling, and the desired structure and characteristics cannot be obtained.

(Cold Rolling Step)

From the viewpoint of maintaining the crosslinked structure of martensite and ferrite formed in the rough rolling and finish rolling steps, it is important to reduce the rolling reduction in cold rolling. By suppressing the rolling reduction in the cold rolling to be low, the crosslinked structure of martensite and ferrite can be maintained even after annealing. In order to obtain this effect, the upper limit of the rolling reduction of the cold rolling is 30%, and preferably 20%. When the rolling reduction of the cold rolling is more than 30%, the crosslinked structure of martensite and ferrite is crushed in the sheet thickness direction, and the heterogeneity $\alpha$ does not satisfy the conditions specified in the present invention. From the viewpoint of homogenization and/or refinement of the structure, the lower limit of the cold rolling is 5%, preferably 7%, and more preferably 10%. Setting the rolling reduction of the cold rolling to 30% or less is an important requirement for satisfying the condition of the heterogeneity $\alpha$ specified in the present invention.

(Annealing Step)

The steel sheet obtained through the cold rolling step is subjected to an annealing treatment. Heating at an annealing temperature is performed and held in a temperature range of $Ac_1$ or higher and 1000° C. or lower for 10 seconds or longer and 1000 seconds or shorter. This temperature range determines the area ratios of ferrite and the hard structure. The upper limit of the temperature range of the annealing treatment is preferably 870° C., and more preferably 850° C. An annealing time is set to 10 seconds or longer in order to sufficiently recrystallize the cold-worked ferrite and to make it easier to control the area ratios of ferrite and the hard structure. When the annealing time is more than 1000 seconds, the productivity deteriorates. Therefore, the annealing time is set to 10 seconds or longer and 1000 seconds or shorter. The upper limit of the annealing time is preferably 300 seconds. The lower limit of the annealing time is preferably 200 seconds.

The $Ac_1$ point is calculated by the following formula.

$$Ac_1=751-16\times C+35\times Si-28\times Mn-16\times Ni+13\times Cr-6\times Cu+3\times Mo$$

In the above formula, C, Si, Mn, Ni, Cr, Cu, and Mo are the amounts (mass %) of the corresponding elements, and 0 mass % is substituted into the elements that are not contained.

After holding the annealing temperature, cooling is performed at a cooling rate of 10° C./s or faster and 200° C./s or slower. In order to freeze the structure and cause the martensitic transformation to efficiently occur, the cooling rate may be fast. However, at a cooling rate of slower than 10° C./s, martensite is not sufficiently generated, and the structure cannot be controlled into a desired structure. On the other hand, even if the cooling rate is more than 200° C./s, the effect is saturated. Therefore, the cooling rate after the annealing is set to 10° C./s or faster and 200° C./s or slower. The upper limit of the cooling rate after the annealing is preferably 50° C./s. The lower limit of the cooling rate after the annealing is preferably 10° C./s. Unlike the average cooling rate, the above cooling rate means that the cooling rate does not fall below 10° C./s in any temperature range during cooling. A cooling stop temperature is set to 200° C. or lower. This is because martensite is generated after the annealing temperature is held. At this time, a step of stopping cooling at 200° C. or higher and 500° C. or lower and holding for 10 seconds or longer and 1000 seconds or lower may be included. The cooling stop temperature is preferably 55° C. or lower, and more preferably 45° C. or lower.

(Tempering Step)

The obtained steel sheet is held in a temperature range of 200° C. or higher and 350° C. or lower by heating in the tempering step. The holding temperature is preferably set to 250° C. or higher and 300° C. or lower. In a case where the holding temperature is lower than 200° C., the martensite is not tempered and the distribution of pre-strain does not change. In a case where the holding temperature is more than 350° C., the total amount of solid solution carbon is reduced due to the precipitation of coarse carbides, resulting in a reduction in the bake hardenability. When the holding temperature becomes higher than the recrystallization temperature of ferrite, the distribution of the interface between ferrite and the primary phase changes due to the recrystallized ferrite generated in the primary phase, and as a result, there are cases where the crosslinked structure of martensite and ferrite is split or collapses. On the other hand, in order to temper the entire hard structure, the retention time is set to 100 seconds or longer. Thereafter, from the viewpoint of productivity, cooling to 100° C. or lower is performed at an average cooling rate of 2° C./s or faster. The cooling stop temperature is preferably 50° C. or lower, and more preferably 45° C. or lower.

(Skin Pass Rolling Step)

The cold-rolled steel sheet manufactured by the above method may be optionally subjected to final skin pass rolling (temper rolling). By performing skin pass rolling, strain is applied to the steel sheet even if there is no pre-strain, so that the bake hardenability can be improved. In order to homogeneously introduce the strain into the steel sheet, the rolling reduction is set to 0.1% or more, and the upper limit thereof is preferably set to 0.5% because it becomes difficult to control the sheet thickness.

In this manner, the cold-rolled steel sheet according to the embodiment of the present invention can be manufactured.

It should be noted that each of the above-described embodiments is merely an example of an embodiment for carrying out the present invention, and the technical scope of the present invention should not be construed as being limited by these embodiments. That is, the present invention can be implemented in various forms without departing from the technical idea or the main features thereof.

EXAMPLES

Next, examples of the present invention will be described. The conditions in the examples are one example of conditions adopted to confirm the feasibility and effects of the present invention, and the present invention is not limited to this one example of conditions. The present invention can adopt various conditions as long as the object of the present invention is achieved without departing from the gist of the present invention.

A slab having the chemical composition shown in Table 1 was manufactured, the slab was heated to 1300° C. for one hour, and thereafter subjected to rough rolling and finish rolling under the conditions shown in Table 2, and the steel sheet was then coiled and held at the coiling temperature for one hour shown in Table 2 to obtain a hot-rolled steel sheet having a sheet thickness of 2 mm. Thereafter, the hot-rolled steel sheet was pickled and cold-rolled at the rolling reduction shown in Table 2 to obtain a cold-rolled steel sheet having the sheet thickness shown in Table 2. Subsequently, annealing, tempering, and/or skin pass rolling were performed under the conditions shown in Table 2.

TABLE 1

| Kind of steel | Chemical composition (mass %) | | | | | | | | | | | | | | | | | | |
|---|---|---|---|---|---|---|---|---|---|---|---|---|---|---|---|---|---|---|---|
| | C | Si | Mn | P | S | Al | N | Ti | Nb | V | Cu | Ni | Mo | Cr | W | Ca | Mg | REM | B |
| A | 0.10 | 1.000 | 2.20 | 0.010 | 0.004 | 0.020 | 0.003 | | | | | | | | | | | | |
| B | 0.13 | 1.000 | 2.20 | 0.011 | 0.004 | 0.020 | 0.003 | 0.030 | | | | | | | | | | | |
| C | 0.15 | 0.900 | 2.90 | 0.012 | 0.004 | 0.020 | 0.003 | | | | | 0.010 | | | | | | | |
| D | 0.11 | 0.800 | 3.00 | 0.011 | 0.004 | 0.020 | 0.003 | | | | | | 0.005 | | | | | | |
| E | 0.20 | 1.200 | 2.10 | 0.010 | 0.004 | 0.020 | 0.003 | | | | 0.010 | | | | | | | | |
| F | 0.20 | 1.200 | 2.00 | 0.010 | 0.004 | 0.020 | 0.003 | | | 0.004 | | | | | | | | | |
| G | 0.03 | 1.000 | 2.50 | 0.012 | 0.004 | 0.020 | 0.003 | | | | | | | | | | | | |
| H | 0.15 | 0.003 | 2.40 | 0.011 | 0.003 | 0.020 | 0.003 | | | | | | | | | | | | |
| I | 0.14 | 0.500 | 2.40 | 0.013 | 0.003 | 0.020 | 0.003 | 0.005 | 0.005 | | | | | | | | | | |
| J | 0.18 | 1.800 | 2.60 | 0.010 | 0.004 | 0.020 | 0.003 | | | | | | | | | 0.003 | | | |
| K | 0.16 | 1.800 | 0.05 | 0.009 | 0.003 | 0.020 | 0.003 | | | | | | | | | | | | |
| L | 0.14 | 0.900 | 2.20 | 0.013 | 0.003 | 0.020 | 0.003 | | | | | | | 0.005 | | | | | |
| M | 0.13 | 1.100 | 2.20 | 0.012 | 0.004 | 0.020 | 0.003 | | | | | | | | 0.005 | | | | |
| N | 0.09 | 1.000 | 2.20 | 0.012 | 0.004 | 0.020 | 0.003 | | | | | | | | | | 0.004 | 0.009 | |
| O | 0.13 | 1.000 | 2.30 | 0.011 | 0.004 | 0.020 | 0.003 | | | | | | | | | | | | 0.0019 |
| P | 0.07 | 0.800 | 2.20 | 0.010 | 0.004 | 0.020 | 0.003 | | | | | | | | | | | | |
| Q | 0.27 | 0.300 | 2.00 | 0.010 | 0.007 | 0.030 | 0.003 | | | | | | | | | | | | |
| R | 0.06 | 0.450 | 3.70 | 0.020 | 0.007 | 0.030 | 0.003 | | | | | | | | | | | | |

Underline indicates outside of the range of the invention.

Blank space in the table indicates that the corresponding chemical element is not intentionally added.

TABLE 2

| No. | Kind of steel | Rough rolling | | | | | | | | | |
|---|---|---|---|---|---|---|---|---|---|---|---|
| | | Heating temperature (° C.) | Rolling reduction of first pass (%) | Rolling reduction of second pass (%) | Rolling reduction of third pass (%) | Rolling reduction of fourth pass (%) | Number of rollings with total of two reciprocations of first to fourth passes as one set (sets) | Maximum rolling reduction of rough rolling (%) | Difference in rolling reduction between two passes in one reciprocation (%) | Rough rolling start temperature (° C.) | Rough rolling completion temperature (° C.) |
| 1 | A | 1300 | 25 | 15 | 15 | 25 | 3 | 25 | 10 | 1250 | 1100 |
| 2 | A | 1300 | 30 | 15 | 15 | 30 | 3 | 30 | 15 | 1200 | 1100 |
| 3 | B | 1300 | 30 | 15 | 15 | 30 | 3 | 30 | 15 | 1200 | 1100 |
| 4 | B | 1300 | 30 | 15 | 15 | 30 | 3 | 30 | 15 | 1200 | 1100 |
| 5 | C | 1300 | 30 | 15 | 15 | 30 | 3 | 30 | 15 | 1200 | 1100 |
| 6 | D | 1300 | 30 | 15 | 15 | 30 | 3 | 30 | 15 | 1200 | 1100 |
| 7 | E | 1300 | 25 | 15 | 15 | 25 | 3 | 25 | 10 | 1200 | 1100 |
| 8 | E | 1300 | 25 | 15 | 15 | 25 | 3 | 25 | 10 | 1250 | 1100 |
| 9 | E | 1300 | 30 | 15 | 15 | 30 | 3 | 30 | 15 | 1250 | 1100 |
| 10 | F | 1300 | 30 | 15 | 15 | 30 | 3 | 30 | 15 | 1200 | 1050 |
| 11 | F | 1300 | 30 | 15 | 15 | 30 | 3 | 30 | 15 | 1200 | 1100 |
| 12 | F | 1300 | 25 | 15 | 15 | 25 | 3 | 25 | 10 | 1200 | 1100 |
| 13 | G | 1300 | 30 | 15 | 15 | 30 | 3 | 30 | 15 | 1250 | 1100 |
| 14 | H | 1300 | 30 | 15 | 15 | 30 | 3 | 30 | 15 | 1200 | 1100 |
| 15 | I | 1300 | 25 | 15 | 15 | 25 | 3 | 25 | 10 | 1200 | 1100 |
| 16 | I | 1300 | 30 | 15 | 15 | 30 | 3 | 30 | 15 | 1200 | 1100 |
| 17 | J | 1300 | 30 | 15 | 15 | 30 | 3 | 30 | 15 | 1200 | 1100 |
| 18 | K | 1300 | 30 | 15 | 15 | 30 | 3 | 30 | 15 | 1200 | 1100 |
| 19 | L | 1300 | 30 | 30 | 15 | 15 | 3 | 30 | 0 | 1200 | 1100 |
| 20 | L | 1300 | 30 | 15 | 15 | 30 | 3 | 30 | 15 | 1200 | 1100 |
| 21 | L | 1300 | 40 | 15 | 15 | 40 | 3 | 40 | 25 | 1200 | 1100 |
| 22 | M | 1300 | 30 | 15 | 15 | 30 | 3 | 30 | 15 | 1200 | 1100 |
| 23 | N | 1300 | 30 | 15 | 15 | 30 | 3 | 30 | 15 | 1200 | 1100 |
| 24 | N | 1300 | 30 | 15 | 15 | 30 | 3 | 30 | 15 | 1200 | 1100 |
| 25 | O | 1300 | 25 | 15 | 15 | 25 | 3 | 25 | 10 | 1250 | 1100 |
| 26 | P | 1300 | 30 | 15 | 15 | 30 | 2 | 30 | 15 | 1200 | 1100 |
| 27 | P | 1300 | 30 | 15 | 15 | 30 | 3 | 30 | 15 | 1250 | 1100 |
| 28 | P | 1300 | 30 | 15 | 15 | 30 | 3 | 30 | 15 | 1250 | 1100 |
| 29 | A | 1300 | 15 | 25 | 15 | 25 | 3 | 25 | 10 | 1250 | 1100 |
| 30 | A | 1300 | 25 | 15 | 25 | 15 | 3 | 25 | 10 | 1250 | 1100 |
| 31 | A | 1300 | 25 | 15 | 15 | 25 | 3 | 25 | 10 | 1250 | 1100 |
| 32 | A | 1300 | 25 | 15 | 15 | 25 | 3 | 25 | 10 | 1250 | 1100 |
| 33 | Q | 1300 | 30 | 15 | 15 | 30 | 3 | 25 | 10 | 1250 | 1100 |
| 34 | R | 1300 | 30 | 15 | 15 | 30 | 3 | 25 | 10 | 1250 | 1100 |
| 35 | S | 1300 | 30 | 15 | 15 | 30 | 3 | 25 | 10 | 1250 | 1100 |

TABLE 2-continued

| No. | Finish rolling: Time until finish rolling after rough rolling (s) | Number of rolling stands | Finish rolling start temperature (° C.) | Rolling reduction of first stand (%) | Finish rolling finishing temperature (° C.) | Coiling temperature (° C.) |
|---|---|---|---|---|---|---|
| 1 | 3 | 4 | 1050 | 10 | 900 | 150 |
| 2 | 3 | 4 | 1050 | 10 | 900 | 150 |
| 3 | 3 | 4 | 1050 | 10 | 850 | 100 |
| 4 | 3 | 4 | 1050 | 10 | 900 | 100 |
| 5 | 3 | 4 | 1050 | 10 | 900 | 150 |
| 6 | 3 | 4 | 1050 | 10 | 900 | 100 |
| 7 | 3 | 4 | 1050 | 10 | 850 | 120 |
| 8 | 3 | 4 | 1050 | 10 | 900 | 100 |
| 9 | 3 | 4 | 1050 | 10 | 900 | 100 |
| 10 | 3 | 4 | 1050 | 10 | 900 | 100 |
| 11 | 3 | 4 | 1050 | 10 | 900 | 150 |
| 12 | 3 | 4 | 1050 | 10 | 900 | 150 |
| 13 | 3 | 4 | 1050 | 10 | 900 | 150 |
| 14 | 3 | 4 | 1050 | 10 | 850 | 150 |
| 15 | 3 | 4 | 1050 | 10 | 900 | 100 |
| 16 | 3 | 4 | 1050 | 10 | 750 | 150 |
| 17 | 3 | 4 | 1050 | 10 | 900 | 100 |
| 18 | 3 | 4 | 1050 | 10 | 900 | 200 |
| 19 | 3 | 4 | 1050 | 10 | 900 | 100 |
| 20 | 3 | 4 | 1050 | 10 | 900 | 100 |
| 21 | 3 | 4 | 1050 | 10 | 900 | 100 |
| 22 | 3 | 4 | 1050 | 10 | 850 | 100 |
| 23 | 3 | 4 | 1050 | 10 | 850 | 100 |
| 24 | 3 | 4 | 1050 | 10 | 900 | 650 |
| 25 | 3 | 4 | 1050 | 10 | 900 | 100 |
| 26 | 3 | 4 | 1050 | 10 | 900 | 150 |
| 27 | 3 | 4 | 1050 | 10 | 900 | 80 |
| 28 | 10 | 4 | 1050 | 10 | 900 | 80 |
| 29 | 3 | 4 | 1050 | 10 | 900 | 150 |
| 30 | 3 | 4 | 1050 | 10 | 900 | 150 |
| 31 | 3 | 4 | 1050 | 10 | 900 | 400 |
| 32 | 3 | 4 | 1050 | 10 | 900 | 150 |
| 33 | 3 | 4 | 1050 | 10 | 900 | 150 |
| 34 | 3 | 4 | 1050 | 10 | 900 | 150 |
| 35 | 3 | 4 | 1050 | 10 | 900 | 150 |

| No. | Cold rolling: Rolling reduction (%) | Sheet thickness t after cold rolling (mm) | Annealing: $Ac_1$ (° C.) | Annealing temperature (° C.) | Annealing time (s) | Cooling rate (° C./s) | Cooling stop temperature (° C.) | Tempering: Tempering holding temperature (° C.) | Tempering retention time (s) | Cooling rate (° C./s) | Cooling stop temperature (° C.) | Skin pass rolling Rolling reduction (%) |
|---|---|---|---|---|---|---|---|---|---|---|---|---|
| 1 | 15 | 1.7 | 723 | 850 | 300 | 50 | 45 | 250 | 600 | 5 | 50 | — |
| 2 | 25 | 1.5 | 723 | 890 | 200 | 50 | 40 | 300 | 5 | 5 | 45 | — |
| 3 | 25 | 1.5 | 722 | 790 | 200 | 50 | 50 | 250 | 600 | 5 | 45 | 0.2 |
| 4 | 50 | 1 | 722 | 850 | 200 | 50 | 45 | 250 | 600 | 5 | 45 | — |
| 5 | 25 | 1.5 | 699 | 800 | 200 | 50 | 45 | 100 | 600 | 5 | 45 | — |
| 6 | 25 | 1.5 | 693 | 820 | 200 | 10 | 45 | 250 | 600 | 5 | 50 | — |
| 7 | 15 | 1.7 | 731 | 820 | 200 | 50 | 45 | 300 | 600 | 5 | 50 | — |
| 8 | 15 | 1.7 | 731 | 660 | 200 | 50 | 50 | 350 | 600 | 5 | 45 | — |
| 9 | 20 | 1.6 | 731 | 830 | 5 | 50 | 50 | 250 | 600 | 5 | 40 | — |
| 10 | 20 | 1.6 | 734 | 850 | 200 | 50 | 40 | 300 | 600 | 5 | 40 | 0.2 |
| 11 | 20 | 1.6 | 734 | 750 | 200 | 1 | 50 | 250 | 600 | 5 | 50 | — |
| 12 | 20 | 1.6 | 734 | 850 | 200 | 50 | 45 | 500 | 600 | 5 | 45 | — |
| 13 | 25 | 1.5 | 716 | 740 | 200 | 50 | 45 | 250 | 600 | 5 | 50 | — |
| 14 | 25 | 1.5 | 682 | 850 | 200 | 50 | 45 | 300 | 600 | 5 | 45 | — |
| 15 | 10 | 1.8 | 699 | 850 | 200 | 50 | 45 | 250 | 600 | 5 | 50 | — |
| 16 | 15 | 1.7 | 699 | 860 | 200 | 50 | 40 | 300 | 600 | 5 | 45 | — |
| 17 | 20 | 1.6 | 738 | 850 | 200 | 50 | 55 | 300 | 600 | 5 | 40 | — |
| 18 | 10 | 1.8 | 810 | 850 | 200 | 50 | 45 | 300 | 600 | 5 | 45 | — |
| 19 | 20 | 1.6 | 719 | 850 | 300 | 50 | 50 | 250 | 600 | 5 | 45 | — |
| 20 | 20 | 1.6 | 719 | 850 | 300 | 50 | 50 | 250 | 600 | 5 | 45 | — |
| 21 | 15 | 1.7 | 719 | 880 | 300 | 50 | 50 | 300 | 600 | 5 | 40 | — |
| 22 | 15 | 1.7 | 726 | 850 | 200 | 50 | 40 | 250 | 600 | 5 | 40 | — |
| 23 | 20 | 1.6 | 723 | 780 | 200 | 50 | 55 | 300 | 600 | 5 | 45 | — |
| 24 | 20 | 1.6 | 723 | 780 | 200 | 50 | 40 | 300 | 600 | 5 | 45 | — |
| 25 | 10 | 1.8 | 720 | 870 | 200 | 50 | 45 | 250 | 600 | 5 | 45 | — |
| 26 | 10 | 1.8 | 716 | 830 | 200 | 50 | 45 | 300 | 600 | 5 | 40 | — |
| 27 | 10 | 1.8 | 716 | 830 | 200 | 50 | 45 | 300 | 600 | 5 | 40 | — |
| 28 | 10 | 1.8 | 716 | 830 | 200 | 50 | 40 | 300 | 600 | 5 | 45 | — |
| 29 | 15 | 1.7 | 723 | 850 | 300 | 50 | 45 | 250 | 600 | 5 | 50 | — |

TABLE 2-continued

| | | | | | | | | | | | | |
|---|---|---|---|---|---|---|---|---|---|---|---|---|
| 30 | 15 | 1.7 | 723 | 850 | 300 | 50 | 45 | 250 | 600 | 5 | 50 | — |
| 31 | 15 | 1.7 | 723 | 850 | 300 | 50 | 45 | 250 | 600 | 5 | 50 | — |
| 32 | 58 | 1.7 | 723 | 850 | 300 | 50 | 45 | 250 | 600 | 5 | 50 | — |
| 33 | 15 | 1.7 | 716 | 850 | 300 | 50 | 45 | 250 | 600 | 5 | 50 | — |
| 34 | 15 | 1.7 | 701 | 850 | 300 | 50 | 45 | 250 | 600 | 5 | 50 | — |
| 35 | 15 | 1.7 | 662 | 850 | 300 | 50 | 45 | 250 | 600 | 5 | 50 | — |

Underline indicates outside of the desirable range.

The steel structure of the obtained cold-rolled steel sheet was observed. In the observation of the steel structure, the area ratio of ferrite, the area ratio of tempered martensite, and the heterogeneity α were obtained by the above methods.

In particular, the area ratio of ferrite and the area ratio of tempered martensite were determined as follows. First, a sample was taken with a sheet thickness cross section perpendicular to the rolling direction of the steel sheet as an observed section, the observed section was polished, the structure thereof at a thickness ¼ position of the steel sheet was observed with SEM-EBSD at a magnification of 5,000-fold, the resultant was subjected to image analysis in a visual field of 100 μm×100 μm to measure the area ratio of ferrite, and the average of values measured at any five visual fields was determined as the area ratio of ferrite.

Furthermore, an SEM secondary electron image of a region at a depth from 3t/8 to t/2 from the surface of the steel sheet was photographed (at a magnification 1,500-fold), and from the fact that white portions of the obtained image data are hard structures and black portions are ferrite, the area ratio of the hard structures was determined based on the image data. The hard structure was determined to be tempered martensite in a case where fine carbides were precipitated in the hard structure when the SEM secondary electron image was observed at 5,000-fold or 10,000-fold. The results are shown in Table 3.

Furthermore, the tensile strength TS, fracture elongation EL, bake hardening amount BH, and minimum bend radius R of the obtained cold-rolled steel sheet were measured. In the measurement of the tensile strength TS, fracture elongation EL, and bake hardening amount BH, JIS No. 5 tensile test pieces whose longitudinal direction was perpendicular to the rolling direction were taken, and a tensile test was conducted according to JIS Z 2241. BH is a value obtained by subtracting the stress at the time of application of 2% pre-strain from the stress when a test piece subjected to a heat treatment at 170° C. for 20 minutes is re-tensioned after the application of 2% pre-strain. The tensile strength is 780 MPa or more in order to satisfy the demand for a reduction in the weight of a vehicle body. Furthermore, the fracture elongation is preferably 10% or more for facilitating forming. In addition, regarding BH, with a BH of less than 100 MPa, it is difficult to perform forming and the strength after forming becomes low. Therefore, a BH of 100 MPa or more is preferable to provide excellent bake hardenability.

R/t, which is the ratio of the minimum bend radius to the sheet thickness, is used as an index for evaluating the bendability after a coating bake hardening treatment. The minimum bend radius R was measured using a V-block method specified in JIS Z 2248 (tip angle of former: 90°, tip radius R: changed from 0.5 mm at a pitch of 05 mm) with a test piece width of 30 mm. When R/t, which is the ratio of the minimum bend radius to the sheet thickness, is 1.0 or more, there are cases where the test piece after the coating bake hardening treatment fractures immediately due to bending stress generated during bellows-like deformation at the time of collision. That is, the collision performance as a component is poor. Therefore, R/t, which is the ratio of the minimum bend radius to the sheet thickness after the measurement of BH, is preferably less than 1.0.

TABLE 3

| | Mechanical property value | | | | Steel structure | | | | |
|---|---|---|---|---|---|---|---|---|---|
| No. | TS (MPa) | EL (%) | BH (MPa) | R/t | A area ratio of ferrite (%) | B area ratio of tempered martensite (%) | A + B | α | Note |
| 1 | 997 | 15 | 115 | 0.59 | 46 | 53 | 99 | 1.08 | Example |
| 2 | 1325 | 9 | 71 | 2 | 44 | 12 | 56 | 1.15 | Comparative Example |
| 3 | 1225 | 11 | 153 | 0.67 | 30 | 70 | 100 | 1.05 | Example |
| 4 | 1108 | 11 | 92 | 2 | 30 | 70 | 100 | 3.85 | Comparative Example |
| 5 | 1379 | 7 | 90 | 2.67 | 33 | 10 | 43 | 3.3 | Comparative Example |
| 6 | 1019 | 11 | 150 | 0.33 | 40 | 59 | 99 | 1.1 | Example |
| 7 | 802 | 18 | 120 | 0.29 | 69 | 31 | 100 | 1.04 | Example |
| 8 | 570 | 35 | 55 | 0.59 | 98 | 2 | 100 | 1.5 | Comparative Example |
| 9 | 771 | 24 | 92 | 1.88 | 75 | 25 | 100 | 3.2 | Comparative Example |
| 10 | 1224 | 12 | 155 | 0.63 | 45 | 55 | 100 | 1.06 | Example |
| 11 | 511 | 30 | 77 | 0.62 | 99 | 1 | 100 | 2.25 | Comparative Example |
| 12 | 890 | 11 | 82 | 1.88 | 44 | 56 | 100 | 5.3 | Comparative Example |
| 13 | 455 | 37 | 67 | 0.33 | 98 | 2 | 100 | 4.03 | Comparative Example |
| 14 | 967 | 12 | 90 | 1.67 | 41 | 59 | 100 | 4.33 | Comparative Example |
| 15 | 1134 | 11 | 140 | 0.56 | 23 | 76 | 99 | 1.1 | Example |
| 16 | 1142 | 9 | 93 | 1.76 | 15 | 85 | 100 | 2.6 | Comparative Example |
| 17 | 1178 | 14 | 122 | 0.63 | 34 | 66 | 100 | 1.04 | Example |
| 18 | 675 | 17 | 50 | 1.39 | 77 | 23 | 100 | 3.35 | Comparative Example |
| 19 | 998 | 14 | 84 | 1.25 | 48 | 52 | 100 | 1.5 | Comparative Example |
| 20 | 1145 | 13 | 130 | 0.63 | 28 | 72 | 100 | 1.12 | Example |

TABLE 3-continued

| | Mechanical property value | | | | Steel structure | | | | |
|---|---|---|---|---|---|---|---|---|---|
| No. | TS (MPa) | EL (%) | BH (MPa) | R/t | A area ratio of ferrite (%) | B area ratio of tempered martensite (%) | A + B | α | Note |
| 21 | 1299 | 6 | 93 | 2.35 | 19 | 81 | 100 | 4.04 | Comparative Example |
| 22 | 1303 | 11 | 152 | 0.29 | 26 | 71 | 97 | 1.06 | Example |
| 23 | 831 | 22 | 119 | 0.63 | 68 | 32 | 100 | 1.09 | Example |
| 24 | 844 | 17 | 92 | 1.88 | 65 | 35 | 100 | 2.99 | Comparative Example |
| 25 | 1254 | 12 | 142 | 0.56 | 22 | 78 | 100 | 1.11 | Example |
| 26 | 1012 | 19 | 82 | 1.11 | 51 | 49 | 100 | 3.1 | Comparative Example |
| 27 | 1004 | 17 | 120 | 0.56 | 50 | 50 | 100 | 0.99 | Example |
| 28 | 1009 | 18 | 88 | 2.22 | 52 | 48 | 100 | 3.66 | Comparative Example |
| 29 | 1002 | 15 | 90 | 1.23 | 44 | 56 | 100 | 1.45 | Comparative Example |
| 30 | 1009 | 18 | 96 | 1.2 | 45 | 55 | 100 | 1.5 | Comparative Example |
| 31 | 1013 | 15 | 97 | 1.56 | 40 | 60 | 100 | 1.58 | Comparative Example |
| 32 | 1001 | 16 | 90 | 1.76 | 44 | 56 | 100 | 1.4 | Comparative Example |
| 33 | 789 | 20 | 101 | 0.29 | 66 | 34 | 100 | 1.08 | Example |
| 34 | 1299 | 11 | 130 | 0.29 | 20 | 80 | 100 | 1.11 | Example |
| 35 | 995 | 14 | 80 | 0.59 | 48 | 52 | 100 | 1.15 | Example |

Underline indicates outside of the range of the invention or outside of the desirable range.

[Evaluation Results]

As shown in Table 3, in Examples 1, 3, 6, 7, 10, 15, 17, 20, 22, 23, 25, 27, 33, 34, and 35, excellent TS, BH, and R/t could be obtained. In any of the examples, TS was 780 MPa or more, BH was 100 MPa or more, and R/t was less than 1.0, which showed that the strength was high, the bake hardenability was excellent, and the bendability after bake hardening was also excellent.

On the other hand, in Comparative Example 2, since the tempering retention time was too short, the tempered martensite did not have a desired area ratio, and the steel had a low BH and a high R/t. In Comparative Example 4, since the rolling reduction of the cold rolling was high, the crosslinked structure of martensite and ferrite could not be maintained, and as a result, the heterogeneity α was large, resulting in a low BH and a high R/t.

In Comparative Example 5, since the tempering retention temperature was low, the tempered martensite did not have a desired area ratio, and the steel had a low BH and a high R/t. In Comparative Example 8, since the annealing temperature was low, the area ratio of ferrite was excessively high, the area ratio of tempered martensite was excessively low, and the steel had low TS and BH.

In Comparative Example 9, since the annealing time was short, the tempered martensite did not have a desired area ratio as a result, and the steel had low TS and BH and a high R/t. In Comparative Example 11, since the cooling rate after annealing was slow, martensite was not sufficiently generated. Therefore, the area ratio of ferrite was excessively high, the area ratio of tempered martensite was excessively low, and TS and BH were low. In Comparative Example 12, since the tempering retention temperature was high, coarse carbides were precipitated, the crosslinked structure of martensite and ferrite could not be maintained due to the generation of recrystallized ferrite, and as a result, the heterogeneity α was large, resulting in a low BH and a high R/t.

In Comparative Example 13, since the C content was low, ferrite and tempered martensite did not have desired area ratios, and the steel had low TS and BH. In Comparative Example 14, since the Si content was low, coarse carbides were precipitated, resulting in a low BH and a high R/t. In Comparative Example 16, since the finish rolling completion temperature was low, the heterogeneity α was large, resulting in a low BH and a high R/t. In Comparative Example 18, since the Mn content was low, tempered martensite did not have a desired area ratio, resulting in low TS and BH and a high R/t.

In Comparative Example 19, since the difference in rolling reduction between the two passes included in one reciprocation of the rough rolling was low, the heterogeneity α was large, resulting in a low BH and a high R/t. In Comparative Example 21, since the rolling reduction of the rough rolling was high, the heterogeneity α was large, resulting in a low BH and a high R/t. In Comparative Example 24, since the coiling temperature was high, the generation of martensite was suppressed, and as a result, the heterogeneity α was large, resulting in a low BH and a high R/t. In Comparative Example 26, since the number of rough rollings was small, a crosslinked structure of tempered martensite and ferrite could not be obtained, and the heterogeneity α was large, resulting in a low BH and a high R/t. In Comparative Example 28, since the retention time from the rough rolling to the finish rolling was long, a crosslinked structure of tempered martensite and ferrite could not be obtained, and the heterogeneity α was large, resulting in a low BH and a high R/t.

In Comparative Example 29, since the rolling reduction of the first pass of the rough rolling was low and the rolling reduction of the second pass of the rough rolling was high, a crosslinked structure of tempered martensite and ferrite could not be obtained, and the heterogeneity α was large, resulting in a low BH and a high R/t. In Comparative Example 30, since the rolling reduction of the third pass of the rough rolling was high and the rolling reduction of the fourth pass of the rough rolling was low, a crosslinked structure of tempered martensite and ferrite could not be obtained, and the heterogeneity α was large, resulting in a low BH and a high R/t. In Comparative Example 31, since the coiling temperature was high, the generation of martensite in the hot-rolled steel sheet was suppressed, so that the amount of strain introduced into ferrite was small, and as a result, the heterogeneity α was large, resulting in a low BH and a high R/t. In Comparative Example 32, since the rolling reduction of the cold rolling was high, the crosslinked structure of martensite and ferrite could not be maintained, and as a result, the heterogeneity α was large, resulting in a low BH and a high R/t.

INDUSTRIAL APPLICABILITY

The cold-rolled steel sheet of the present invention can be used as a structural member of a vehicle, particularly in an automotive industry field.

The invention claimed is:

1. A cold-rolled steel sheet comprising, by mass %:

C: 0.05% to 0.30%;
Si: 0.200% to 2.000%;
Mn: 2.00% to 4.00%;
P: 0.100% or less;
S: 0.010% or less;
Al: 0.001% to 2.000%;
N: 0.010% or less;
Ti: 0% to 0.100%;
Nb: 0% to 0.100%;
V: 0% to 0.100%;
Cu: 0% to 1.000%;
Ni: 0% to 1.000%;
Mo: 0% to 1.000%;
Cr: 0% to 1.000%;
W: 0% to 0.005%;
Ca: 0% to 0.005%;
Mg: 0% to 0.005%;
REM: 0% to 0.010%;
B: 0% to 0.0030%; and
a remainder comprising Fe and impurities, wherein the cold-rolled steel sheet contains 20% or more and 70% or less of ferrite and 30% or more of tempered martensite in terms of area ratio, a sum of ferrite and tempered martensite is 90% or more, and in a case where in a sheet thickness cross section perpendicular to a sheet width direction of the steel sheet at a position from ⅛ to ⅞ of a sheet width of the cold-rolled steel sheet, a microstructure image of 30 μm×30 μm obtained by photographing a structure at a position from ¼ to ⅜ of a sheet thickness from a surface of the cold-rolled steel sheet at a magnification of 2,000-fold is disposed in an xy coordinate system having a sheet thickness direction as an x-axis and a rolling direction as a y-axis, the microstructure image is divided into 1024 pieces in an x-axis direction and 1024 pieces in a y-axis direction to form 1024×1024 divided regions, and a two-dimensional image is created by performing double gradation by assuming a value of "1" in each of the divided regions in one case where the structure is ferrite and assuming a value of "0" in the other cases, a heterogeneity a defined by Formula (1) for the two-dimensional image is 1.20 or less,

[Formula 1]

$$\alpha = \frac{S_u}{S_v} \tag{1}$$

in Formula (1), Su is defined by Formula (2), and Sv is defined by Formula (3),

[Formula 2]

$$S_u = \sum_{u=1}^{1023} \|F(u, 0)\| \tag{2}$$

$$S_v = \sum_{u=1}^{1023} \|F(0, v)\| \tag{3}$$

in Formula (2) and Formula (3), F(u,v) is defined by Formula (4), and

[Formula 3]

$$F(u, v) = \sum_{x=0}^{1023} \sum_{y=0}^{1023} f(x, y) e^{-2\pi i\left(\frac{ux}{1024} + \frac{vy}{1024}\right)} \tag{4}$$

in Formula (4), f(x,y) represents a gradation of coordinates (x,y) of the two-dimensional image.

2. The cold-rolled steel sheet according to claim 1, further comprising, by mass %, one or two or more of;

Ti: 0.003% to 0.100%,
Nb: 0.003% to 0.100%, and
V: 0.003% to 0.100%, in a total amount of 0.100% or less.

* * * * *